US007503860B2

(12) United States Patent
Gazzara et al.

(10) Patent No.: US 7,503,860 B2
(45) Date of Patent: Mar. 17, 2009

(54) SPORTS RACQUET WITH MULTI-SECTION FRAME

(75) Inventors: Roberto Gazzara, Mestre (IT); Mauro Pinaffo, Camposampiero (IT); Michele Pozzobon, Fossalonga di Vedelago (IT); Mauro Pezzato, Treviso (IT)

(73) Assignee: Prince Sports, Inc., Bordentown, NJ (US)

( * ) Notice: Subject to any disclaimer, the term of this patent is extended or adjusted under 35 U.S.C. 154(b) by 190 days.

(21) Appl. No.: 11/584,207

(22) Filed: Oct. 20, 2006

(65) Prior Publication Data

US 2007/0123376 A1 May 31, 2007

(30) Foreign Application Priority Data

Nov. 29, 2005 (EP) ..... 05111444

(51) Int. Cl.
*A63B 49/02* (2006.01)

(52) U.S. Cl. ..... 473/535; 473/524; 473/536; 473/540

(58) Field of Classification Search ..... 473/524, 473/535, 536, 539, 540; D21/729
See application file for complete search history.

(56) References Cited

U.S. PATENT DOCUMENTS

| | | | |
|---|---|---|---|
| 59,313 | A | 10/1866 | Hill |
| 729,639 | A | 6/1903 | McCoy |
| 1,025,478 | A | 5/1912 | Murphy |
| 1,530,427 | A | 3/1925 | Simon |
| 2,033,722 | A | 3/1936 | MacFarland |
| 2,321,771 | A | 6/1943 | Rumelin |
| 3,377,066 | A | 4/1968 | Trowbridge |
| 3,392,986 | A | 7/1968 | Hayes |
| 4,086,115 | A | 4/1978 | Sweet |
| 4,124,208 | A | 11/1978 | Burns |
| 4,264,389 | A | 4/1981 | Staub |
| 4,358,113 | A | 11/1982 | McKinnon |
| 4,600,193 | A | 7/1986 | Merritt |
| 4,795,153 | A | 1/1989 | Thomas |
| 4,931,247 | A | 6/1990 | Yeh |
| 5,082,279 | A | 1/1992 | Hull |
| 5,097,870 | A | 3/1992 | Williams |
| 5,153,798 | A | 10/1992 | Ruigrok |
| 5,179,255 | A | 1/1993 | Yeh |
| 5,249,846 | A | 10/1993 | Martin |
| 5,285,008 | A | 2/1994 | Sas-Jaworsky |
| 5,297,791 | A | 3/1994 | Negishi |

(Continued)

FOREIGN PATENT DOCUMENTS

| | | |
|---|---|---|
| CA | 2154370 | 3/1997 |

(Continued)

OTHER PUBLICATIONS

European Search Report, Apr. 6, 2006, Lamier.

*Primary Examiner*—Raleigh W. Chiu
(74) *Attorney, Agent, or Firm*—Cowan, Liebowitz & Latman, P.C.

(57) ABSTRACT

A sports racquet frame is formed from a plurality of frame sections, some sections formed of a single tubular member and other sections formed of double tubular members. The double tube sections preferably contain string port holes. Also, different frame sections can be made of different materials, e.g., carbon fiber-reinforced composites and aluminum.

9 Claims, 3 Drawing Sheets

U.S. PATENT DOCUMENTS

| | | | | |
|---|---|---|---|---|
| 5,301,940 | A | 4/1994 | Seki | |
| 5,303,916 | A | 4/1994 | Rodgers | |
| 5,312,102 | A | 5/1994 | Stennett | |
| 5,419,553 | A | 5/1995 | Rodgers | |
| 5,614,305 | A | 3/1997 | Paine | |
| 5,636,836 | A | 6/1997 | Carroll | |
| 5,746,955 | A | 5/1998 | Calapp | |
| 5,766,104 | A | 6/1998 | Albarelli | |
| 5,865,696 | A | 2/1999 | Calapp | |
| 5,879,250 | A | 3/1999 | Tahtinen | |
| 5,975,645 | A | 11/1999 | Sargent | |
| 6,012,996 | A * | 1/2000 | Lo | 473/547 |
| 6,042,493 | A | 3/2000 | Chauvin | |
| 6,071,203 | A * | 6/2000 | Janes et al. | 473/535 |
| 6,086,161 | A | 7/2000 | Luttgeharm | |
| 6,113,508 | A | 9/2000 | Locarno | |
| 6,129,962 | A | 10/2000 | Quigley | |
| 6,241,633 | B1 | 6/2001 | Conroy | |
| 6,383,101 | B2 | 5/2002 | Eggiman | |
| 6,485,382 | B1 | 11/2002 | Chen | |
| 6,589,125 | B1 * | 7/2003 | Tsai | 473/539 |
| 6,638,187 | B1 * | 10/2003 | Tsai | 473/540 |
| 6,663,517 | B2 | 12/2003 | Buiatti | |
| 6,723,012 | B1 | 4/2004 | Sutherland | |
| 6,761,653 | B1 | 7/2004 | Higginbotham | |
| 6,764,419 | B1 | 7/2004 | Giannetti | |
| 6,776,735 | B1 | 8/2004 | Belanger | |
| 6,800,239 | B2 | 10/2004 | Davis | |
| 6,808,464 | B1 | 10/2004 | Nguyen | |
| 6,866,598 | B2 | 3/2005 | Giannetti | |
| 6,872,156 | B2 | 3/2005 | Ogawa | |
| 7,014,580 | B2 | 3/2006 | Forsythe | |
| 7,077,768 | B2 * | 7/2006 | Filippini | 473/535 |
| 7,207,907 | B2 | 4/2007 | Guenther | |
| 7,309,299 | B2 | 12/2007 | Pezzato | |
| 7,396,303 | B2 | 7/2008 | Gazzara | |
| 2003/0104152 | A1 | 6/2003 | Sommer | |
| 2003/0162613 | A1 | 8/2003 | Davis | |
| 2004/0048683 | A1 | 3/2004 | Burrows | |
| 2004/0198538 | A1 | 10/2004 | Goldsmith | |
| 2004/0198539 | A1 | 10/2004 | Sutherland | |
| 2005/0062337 | A1 | 3/2005 | Meggiolan | |
| 2005/0153799 | A1 | 7/2005 | Rigoli | |
| 2005/0164814 | A1 | 7/2005 | Tucker | |
| 2005/0221924 | A1 | 10/2005 | Sutherland | |
| 2005/0266940 | A1 * | 12/2005 | Filippini | 473/535 |
| 2006/0122013 | A1 | 6/2006 | Dodge | |
| 2006/0247077 | A1 | 11/2006 | Deetz | |
| 2007/0123376 | A1 * | 5/2007 | Gazzara et al. | 473/524 |
| 2007/0135245 | A1 * | 6/2007 | Gazzara et al. | 473/524 |
| 2007/0200422 | A1 | 8/2007 | Davis | |
| 2007/0222178 | A1 | 9/2007 | Davis | |
| 2007/0238560 | A1 | 10/2007 | Gazzara | |
| 2007/0270253 | A1 | 11/2007 | Davis | |
| 2007/0275799 | A1 | 11/2007 | Davis | |
| 2007/0293344 | A1 | 12/2007 | Davis | |

FOREIGN PATENT DOCUMENTS

| | | |
|---|---|---|
| CA | 2231908 | 9/1999 |
| DE | 4415509 | 11/1995 |
| EP | 1097730 | 5/2001 |
| EP | 1859838 | 11/2007 |
| EP | 1859839 | 11/2007 |
| JP | 53038431 | 4/1978 |
| JP | 02255164 | 10/1990 |
| JP | 05015624 | 1/1993 |
| JP | 09117968 | 5/1997 |
| JP | 11276652 | 10/1999 |
| JP | 2000042155 | 2/2000 |
| WO | WO 84/03447 | 9/1984 |
| WO | WO 94/26361 | 11/1994 |
| WO | WO 00/09219 | 2/2000 |
| WO | WO 01/26752 | 4/2001 |
| WO | WO 03/076176 | 9/2003 |
| WO | WO2004/075996 | 9/2004 |
| WO | WO 2004/075996 | 9/2004 |

* cited by examiner

SPORTS RACQUET WITH MULTI-SECTION FRAME

BACKGROUND OF THE INVENTION

The present invention relates to sports racquets, for example tennis, squash, badminton, and racquetball racquets. Such racquets have a head portion containing an interwoven string bed, a handle, and a shaft portion connecting the head portion to the handle.

In conventional racquets, holes for anchoring the ends of the strings are formed in the frame by drilling small string holes in the frame after the racquet is molded. Generally, each string hole accommodates a single string. Plastic grommet pegs, which are formed on a grommet strip that extends along the outside surface of the frame, extend through the string holes to protect the strings from the sharp edges of the drilled holes.

Co-owned PCT application WO 2004/075996 discloses a sports racquet in which some adjacent pairs of small string holes along the sides, tip, and throat bridge of the racquet are replaced by enlarged string holes, the opposite ends of which each accommodates one string (referred to herein as "port string holes"). Preferably the frame is formed of a double tube of carbon fiber-reinforced composite material (a so-called graphite frame), in which the enlarged string holes are molded into as the racquet as the racquet is pressure molded. As a result of using two tubes, each forming one-half of the enlarged string hole, the string holes can have rounded edges and do not require the use of grommet pegs or strips. Also, in the regions between string holes, the adjoining walls of the two tubes are bonded together to form an internal stiffening wall lying in the plane of the string bed. The result is a racquet which has improved torsional stiffness and lighter weight.

The playing characteristics of a graphite sports racquet can be changed in various ways, such as by changing the geometric shape of the frame, the materials used, the number and fiber orientation of the various plies of composites used at each racquet location, or the frame's overall weight, balance, stiffness, and polar and mass moments of inertia. While racquet designers currently have substantial latitude in designing the various playing characteristics of a racquet, it would be desirable to allow for even greater flexibility in the ability to design a new racquet's playing characteristics.

BRIEF SUMMARY OF THE INVENTION

A racquet according to the present invention includes a frame which is formed from a plurality of frame sections. In one embodiment, the opposite sides of the head and the tip are each formed by a separate frame section. Each frame includes a plurality of string port holes, formed either in the frame, e.g., as disclosed in WO 2004/075996, or formed in insert members. The upper and lower corners of the head are separate members and contain conventional string holes designed to receive either a single string or a pair of strings. Preferably, the lower frame corners are joined to shaft members and a handle portion of the frame as a unitary lower frame piece.

The corner sections may be formed of a material which is different from the side sections and the tip sections. Also, the upper corner sections and the lower frame piece may have a construction which is different from the frame constructions in the side sections and the tip sections. Most preferably, the upper corners are formed of a single hollow graphite tube, and the lower frame piece is formed by a pair of single hollow graphite tubes, whereas the side sections and tip section are formed of a pair of graphite tubes molded so that the facing walls of the tubes define the string port holes.

If the tip section is to use conventional string holes, the tip section and upper corners may be formed as a single, continuous piece of graphite tubing.

The various racquet sections may be formed individually and then joined together, or molded together in a modification of known inflation molding techniques. In a conventional inflation molding process, an inflatable bladder is disposed inside a prepreg tube of uncured composite material. The tube, which is flexible at this stage, is placed inside a mold which, when closed, is shaped as a racquet frame. The bladder is then inflated, such that the tube assumes the shape of the mold, while the mold is heated to cure the epoxy resin.

According to one method of the invention, a plurality of prepreg sections are formed. In the sections that will become the lower frame section, and the upper corners, the prepreg section is a single tube. In the sections that will become the side sections and tip section, a double tube is provided. A pair of inflatable bladders extend through each of the single tubes, and one bladder extends through each of the double tubes. The prepreg tube may be wrapped with additional prepreg sheets to connect the various sections prior to being placed in the mold.

Within the mold, a plurality of mold elements, whose outside surfaces are shaped to form string port holes, are positioned between the double tubes at the desired locations. Molding is then carried out in the conventional way. After the frame has been removed from the mold, the mold elements are removed.

Alternatively, the various frame sections can be formed separately and then joined together. The sections can be produced in separate molds. Each element is designed to be joined together with a suitable connection. These connections will permit and assure the assembly of a plurality of elements which will form the frame of the racquet. A mold will be used as reference in order to grant the correct positioning of the elements and the connection to the frame contour. The elements, properly fitted together, will be joined by a mechanical junction (obtained by particular geometries of the elements) or by an epossidic glue.

The string port holes can have any suitable shape, such as elliptical, circular, polygonal, rounded, convex, concave, or irregular. The use of enlarged string holes allows the overall weight of the racquet to be reduced and makes stringing easier.

Other features and advantages of the invention will become apparent from the following description of preferred embodiments, taken in conjunction with the drawings.

DETAILED DESCRIPTION OF THE INVENTION

Figure 1:
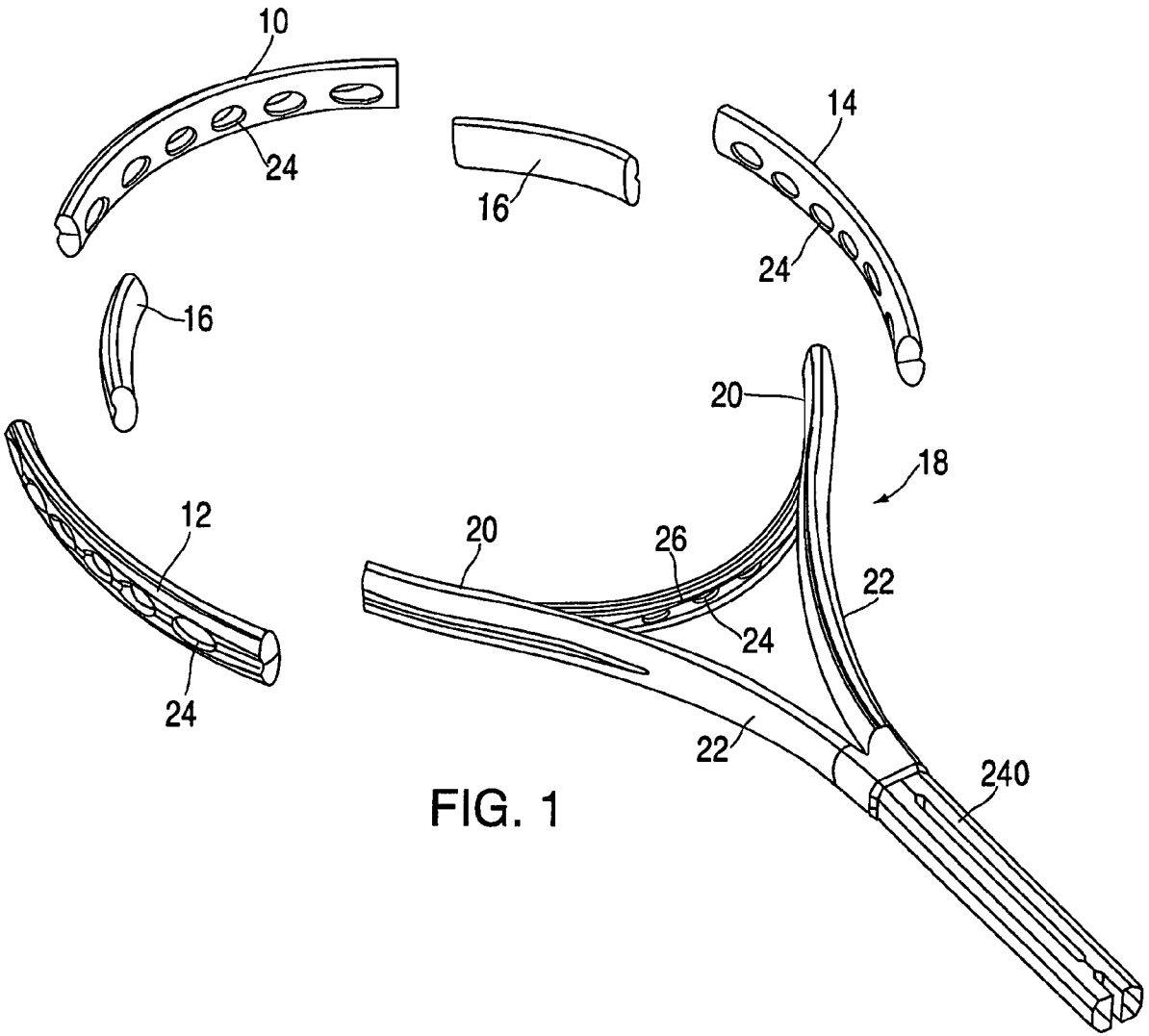
FIG. 1 is an exploded, perspective view a tennis racquet frame according to one embodiment of the invention.
Figure 2:
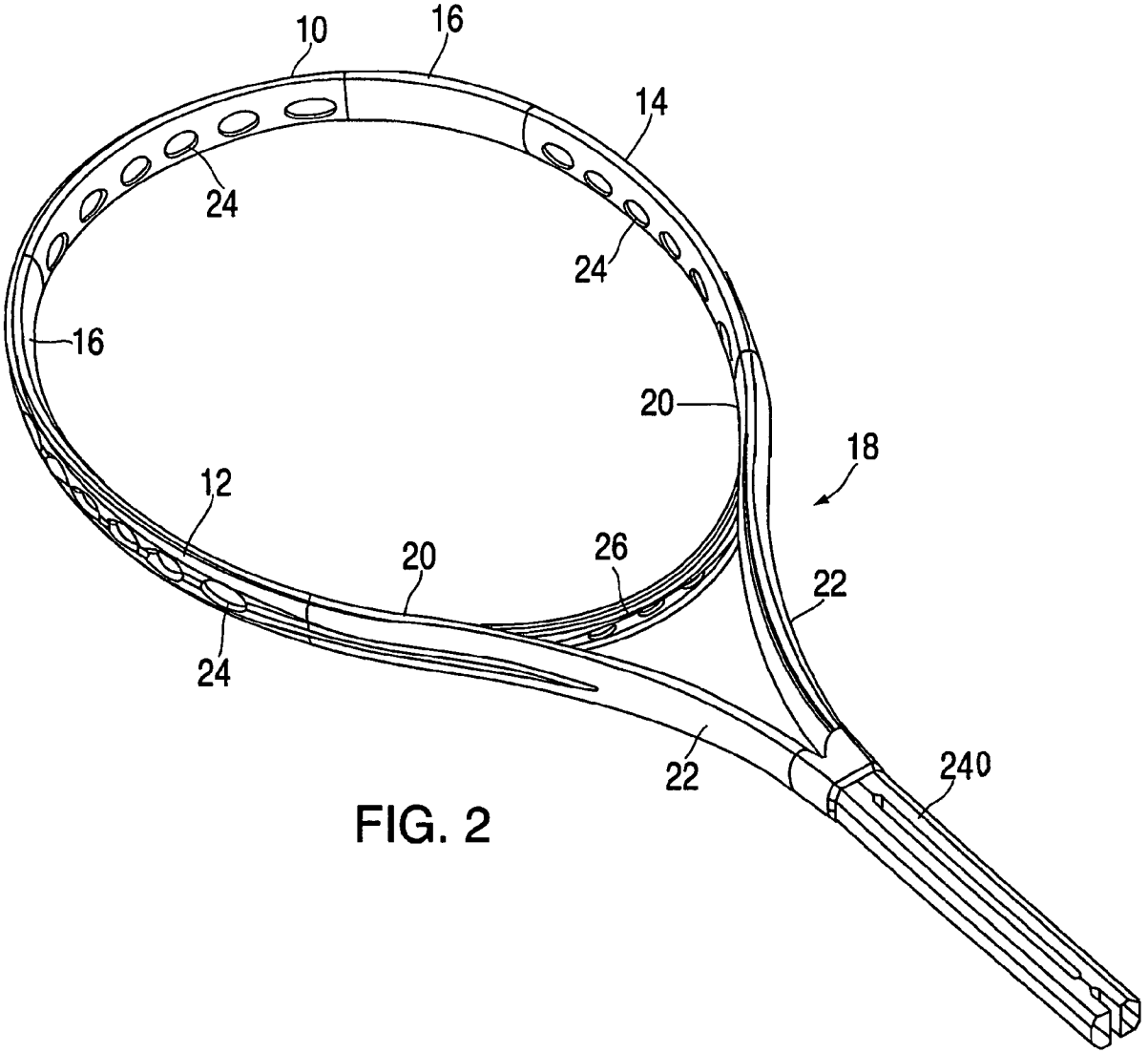
FIG. 2 is a perspective view of the racquet frame of FIG. 1.

FIGS. 1 and 2 show a tennis racquet frame which comprises a plurality of separate sections. In the example, the frame includes tip section 10, a pair of side sections 12, 14, a pair of upper corner sections 16, and a lower frame section 18. The lower frame section 18 comprise the lower corners 20 of the head, a pair of converging shafts 22, and a handle portion 24. The lower frame section 18 also includes a throat bridge 26, if a throat bridge is used.

As shown in FIG. 1, a continuous tubular member forms the lower corner section 20, shaft 22, and handle half on either side of the frame. Also, the upper corner sections 16 are each formed by a single tubular frame member. The side sections 12, 14 are formed of a dual tube frame and include a plurality of string port holes 24 formed therein. The throat bridge 26 may also include a plurality of string port holes 24.

Figure 3:
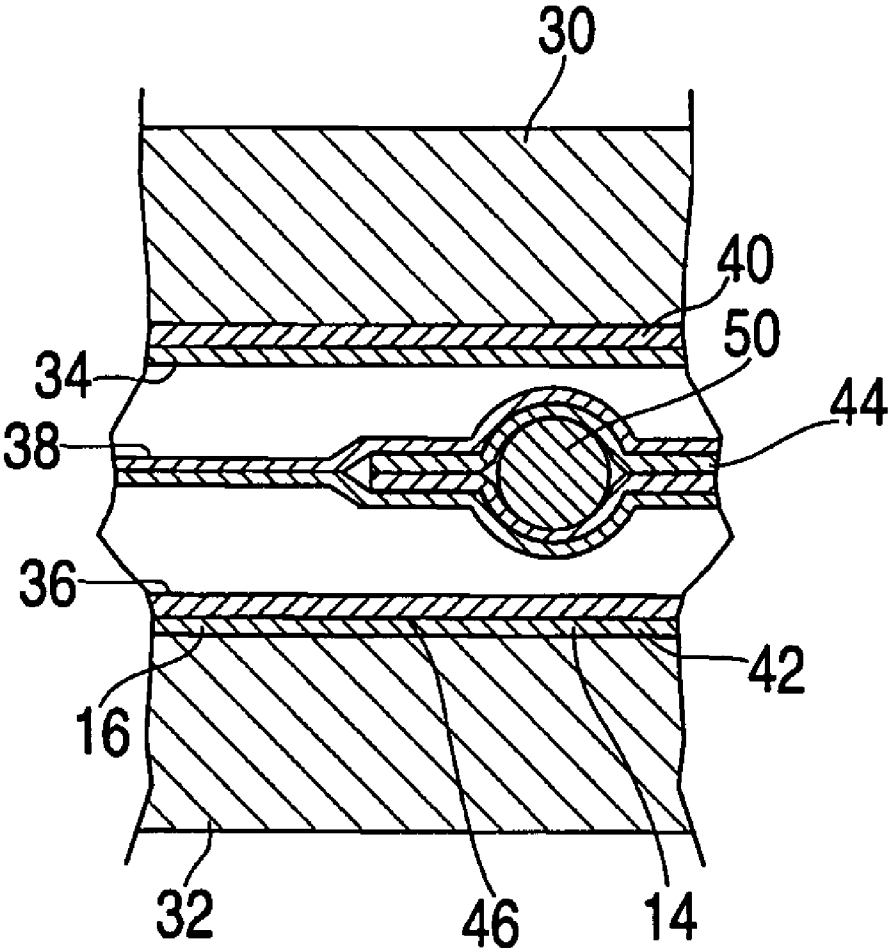
FIG. 3 is a schematic drawing of a portion of a side section and upper corner during molding.

FIG. 3 illustrates one method of forming a racquet frame, with distinct frame sections, using inflation molding techniques. In conventional inflation molding of sports racquets, a prepreg tube of uncured composite material, surrounding an inflatable bladder, is placed inside a mold which, when closed, has the desired shape of the racquet frame. After the mold is closed, the bladder is inflated, so that the tube assumes the shape of the mold, and the mold is heated to cure the composite resin.

In the process of FIG. 3, a pair of inflatable bladders are used. FIG. 3 illustrates schematically a portion of the frame where the side section 14 joins the upper corner section 16 as they are being molded. The tubular sections 14, 16 are contained within a closed mold having mold elements 30, 32.

The corner section 16 contains a single tube of composite material. A pair of bladders 34, 36 are disposed inside the corner section 16. As shown, the bladders 34, 36 meet along a common wall 38 when inflated.

The side section 14 includes a pair of tubes 40, 42. Bladder 34 extends inside of tube 40, whereas bladder 36 extends inside of tube 42. When the tubes 40, 42 are inflated by the bladders 34, 36, they meet along a common wall 44 and fuse together to form an interior wall.

As shown in FIG. 3, prior to molding a mold insert member 50 is inserted between the upper tube 40 and the lower tube 42 at each location where it is desired to form a string port hole 24. The mold insert members 50 have an outer surface with the desired shape of the string port hole 24. Although the holes 24 are shown as elliptical, they can have any desired shape, such as rectangular, circular, or other shape. Preferably, the mold insert members 50 are shaped to form a rounded lip on the outside surface of the holes 24, where the string enters and leaves.

The prepreg tubes which will form the various sections of the frame may be preformed by wrapping sheets of prepreg on a common mandrel over the bladders. Preferably, sheets of prepreg are wrapped over the joints 46 between adjoining sections so that the sections bond together during molding.

Alternatively, the various sections of the frame may be formed individually and then subsequently joined using a suitable joint. For example, In the above process, string port holes 24 are molded into the racquet frame. String holes in the corners may be drilled in a conventional fashion. As described in PCT application WO 2004/075996, the string port holes 24 on one side of the frame are offset relative to the string port holes 24 on the other side of the frame (the same is true for the tip section and throat bridge) to accommodate stringing. Thus, a string which enters one string port hole bears against the upper wall of the string port hole, wraps around the outside of the frame, and bears against the lower wall of the string port hole immediately above it. After crossing the string bed, the string bears against the upper wall of the opposing (offset) port string hole, wraps around the outside of the frame, and bears against the lower wall of the port hole immediately above.

In the example above, the various sections of the frame are made from carbon fiber-reinforced composite. The type of composite used may vary from section-to-section or be the same. Also, the sections can be made of different materials, such as a combination of composite material, metal such as aluminum, nanomaterials, plastics, or wood.

As used herein, the term "sides" refers generally to the regions of the racquet head between the upper and lower corners, and the "tip" refers generally to the region of the head between the upper corners. However, since these terms are not terms of art, "sides" and "tip," as used herein, can include any portion of the sides or tip, or even include a portion of persons might consider to be the corners.

The foregoing represent preferred embodiments of the invention. Variations and modifications will be apparent to persons skilled in the art, without departing from the inventive concepts disclosed herein. For example, if desired the tip section can employ conventional string holes rather than string port holes, in which case the tip section and upper corners can be formed from a single, continuous prepreg tube. In another example, the tip section is made of a double tube aluminum profile, the sides are made of a single carbon fiber tube, with ports formed as described herein. Such modifications and variations are intended to be within the scope of the invention, as defined in the following claims.

The invention claimed is:

1. A sports racquet frame including a pair of opposed side sections, a tip section, and a pair of corner sections joined to and separating the side sections and tip section, wherein said corner sections are formed of a single tubular member and said side sections are formed of a pair of tubular members.

2. A sports racquet as defined in claim 1, wherein each said side section includes a plurality of string port holes.

3. A sports racquet as defined in claim 1, wherein said tip section is formed of a pair of tubular members.

4. A sports racquet as defined in claim 1, wherein said upper corners and tip section are formed of a single tubular member.

5. A sports racquet as defined in claim 1, wherein said side sections and upper corner sections are formed of different materials.

6. A sports racquet as defined in claim 1, wherein said frame includes a pair of lower corner sections joined to said side sections, and wherein each said lower corner section is formed of a single tubular member.

7. A sports racquet as defined in claim 6, wherein said frame includes a pair of converging shafts, each joined to a lower corner section, and a handle portion joined to said shafts, and wherein said lower corner sections, shafts, and handle portion are formed by a pair of tubular members.

8. A process for making a sports racquet having side sections and upper corner sections comprising the steps of forming a pair of side sections each comprising a pair of tubular members and a pair of upper corner sections, each formed of a single tubular member, and joining each upper corner section to a side section.

9. A process according to claim 8, comprising the steps of providing a pair of prepreg tubes for forming one of said side sections and a single prepreg tube for forming an upper corner section; joining an end of said single prepreg tube with ends of said pair at a joint region; providing a pair of inflatable bladders; directing one bladder through each of said pair of prepreg tubes and both bladders through said single prepreg tube; positioning said prepreg tubes in a mold; positioning a plurality of mold insert members, each shaped to form a string port hole, between said pair of prepreg tubes; inflating said bladders while heating said mold to form said frame; and removing said mold insert members from said frame.

* * * * *